US010030620B2

(12) United States Patent
Yamamoto et al.

(10) Patent No.: US 10,030,620 B2
(45) Date of Patent: Jul. 24, 2018

(54) FUEL INJECTION VALVE

(71) Applicant: DENSO CORPORATION, Kariya, Aichi-pref. (JP)

(72) Inventors: Shinsuke Yamamoto, Kariya (JP); Eiji Itoh, Kariya (JP); Eiji Mimura, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/111,294

(22) PCT Filed: Feb. 4, 2015

(86) PCT No.: PCT/JP2015/000491
§ 371 (c)(1),
(2) Date: Jul. 13, 2016

(87) PCT Pub. No.: WO2015/118861
PCT Pub. Date: Aug. 13, 2015

(65) Prior Publication Data

US 2016/0333838 A1 Nov. 17, 2016

(30) Foreign Application Priority Data

Feb. 5, 2014 (JP) ..... 2014-020475

(51) Int. Cl.
*F02M 61/14* (2006.01)
*F02M 51/06* (2006.01)

(52) U.S. Cl.
CPC ..... *F02M 61/14* (2013.01); *F02M 51/0685* (2013.01); *F02M 2200/858* (2013.01)

(58) Field of Classification Search
CPC ..... F02M 61/14; F02M 51/0685; F02M 2200/858
See application file for complete search history.

(56) References Cited

U.S. PATENT DOCUMENTS 3,841,277 A * 10/1974 Schafer ..... F02M 61/145 123/470
6,263,863 B1 7/2001 Giovannini et al.
(Continued)

FOREIGN PATENT DOCUMENTS

JP 2003-227434 8/2003
JP 2010-185323 8/2010
(Continued)

*Primary Examiner* — Hung Q Nguyen
*Assistant Examiner* — Xiao Mo
(74) *Attorney, Agent, or Firm* — Nixon & Vanderhye P.C.

(57) ABSTRACT

A fuel injection valve includes a housing having a nozzle hole, a valve seat, and a fuel passage; a needle that is accommodated in the housing to be capable of reciprocating in an axial direction of the housing and that opens or closes the nozzle hole; a coil; a fixed core; a movable core; a shift permitting member that is provided between the housing and an internal-combustion engine to permit a shift of an attachment position at time of attachment of the housing and the engine; and a friction reducing part that is provided between the engine and the shift permitting member to reduce friction between the engine and the shift permitting member. The friction reducing part permits displacement of the housing in a direction perpendicular to the axial direction of the housing.

4 Claims, 8 Drawing Sheets

(56) References Cited

U.S. PATENT DOCUMENTS

| | | | | |
|---|---|---|---|---|
| 2004/0040543 | A1* | 3/2004 | Mickelson | F02M 61/14 123/470 |
| 2007/0182102 | A1* | 8/2007 | Mormile | F16J 15/3452 277/361 |
| 2009/0050113 | A1* | 2/2009 | Liskow | F02M 61/14 123/470 |
| 2009/0071445 | A1 | 3/2009 | Mueller et al. | |
| 2011/0057059 | A1* | 3/2011 | Yamamoto | F02M 51/0675 239/584 |
| 2011/0155824 | A1* | 6/2011 | Fischer | F02M 61/14 239/533.2 |
| 2011/0247591 | A1* | 10/2011 | Holt | F02M 61/14 123/470 |
| 2012/0104120 | A1* | 5/2012 | Holt | F16F 1/328 239/533.2 |
| 2013/0014719 | A1 | 1/2013 | Sugiyama et al. | |
| 2015/0013644 | A1* | 1/2015 | Friedrich | F02M 55/004 123/470 |
| 2015/0316014 | A1* | 11/2015 | Pohlmann | F02M 61/14 123/470 |

FOREIGN PATENT DOCUMENTS

| | | |
|---|---|---|
| JP | 2010-216262 | 9/2010 |
| JP | 2011-196293 | 10/2011 |

* cited by examiner

FUEL INJECTION VALVE

CROSS REFERENCE TO RELATED APPLICATION

This application is the U.S. national phase of International Application No. PCT/JP2015/000491 filed 4 Feb. 2015 which designated the U.S. and claims priority to Japanese Patent Application No. 2014-20475 filed on Feb. 5, 2014, the entire contents of each of which are hereby incorporated herein by reference.

TECHNICAL FIELD

The present disclosure relates to a fuel injection valve that injects fuel directly into an internal-combustion engine (hereinafter referred to as an engine).

BACKGROUND ART

A fuel injection valve that injects fuel directly into a combustion chamber of an engine is conventionally provided between a delivery pipe connected to a high-pressure pump that pressurizes fuel, and a cylinder head of the engine. In Patent Document 1, for example, there is described a fuel injection valve whose part serving as the rotation center is provided near a nozzle hole such that the valve can rotate in accordance with a position shift of a delivery pipe from a cylinder head.

PRIOR ART DOCUMENT

Patent Document

Patent Document 1: JP2011-196293A

At the time of attachment of the cylinder head and the fuel injection valve, the fuel injection valve provided between the delivery pipe and the cylinder head is attached to the cylinder head via a tolerance ring that permits an attachment position shift. When an internal-combustion engine is operated in a relatively low-temperature environment, the cylinder head expands due to the heat of combustion in the internal-combustion engine, and the delivery pipe contracts due to the relatively low-temperature fuel flowing through the delivery pipe. For this reason, the position of the delivery pipe relative to the cylinder head that is aligned at the time of attachment is shifted to change a distance between a part of the cylinder head, to which an injection part including the nozzle hole is connected, and a part of the delivery pipe, to which a fuel introduction pipe for introducing fuel into the fuel injection valve is connected. When the position of the delivery pipe relative to the cylinder head is shifted, the fuel injection valve described in Patent Document 1 rotates with the vicinity of the nozzle hole as the rotation center. Thus, if the change of this distance is great, the valve cannot sufficiently meet the change and may deform. If this distance change cannot be sufficiently permitted by the tolerance ring, the fuel injection valve may deform and injection characteristics of the fuel injection valve may deteriorate.

SUMMARY OF INVENTION

The present disclosure addresses the above issues. Thus, it is an objective of the present disclosure to provide a fuel injection valve that prevents deterioration of fuel injection characteristics.

To achieve the above objective, a fuel injection valve for injecting fuel directly into a combustion chamber of an internal-combustion engine in an aspect of the present disclosure includes a housing having a nozzle hole, a needle that is accommodated in the housing to be capable of reciprocating in an axial direction of the housing and that opens or closes the nozzle hole, a coil, a fixed core, a movable core, a shift permitting member that is provided between the housing and the internal-combustion engine to permit a shift of an attachment position at time of attachment of the housing and the internal-combustion engine, and a friction reducing part that is provided between the internal-combustion engine and the shift permitting member. The friction reducing part reduces friction between the internal-combustion engine and the shift permitting member, and permits displacement of the housing in a direction perpendicular to the axial direction of the housing.

The fuel injection valve in this aspect includes the friction reducing part between the shift permitting member and the internal-combustion engine, for reducing friction between the shift permitting member and the internal-combustion engine. When such an extent of force that can deform the fuel injection valve is applied to the fuel injection valve due to a position shift of a delivery pipe relative to the internal-combustion engine at the time of actual use of the fuel injection valve, the fuel injection valve in the present aspect is displaced in a direction perpendicular to the axial direction of the housing. "Perpendicular" means not only being perpendicular in the strict sense but also such an extent of angular relation that can be visually recognized as being perpendicular to the axial direction of the housing. Accordingly, the fuel injection valve of the present aspect prevents the fuel injection valve from being deformed because of the position shift of the delivery pipe relative to the internal-combustion engine. Therefore, deterioration of fuel injection characteristics due to the deformation of the fuel injection valve is prevented, and damage to the fuel injection valve is prevented.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

Embodiments will be described below in reference to the drawings.

First Embodiment

Figure 1:
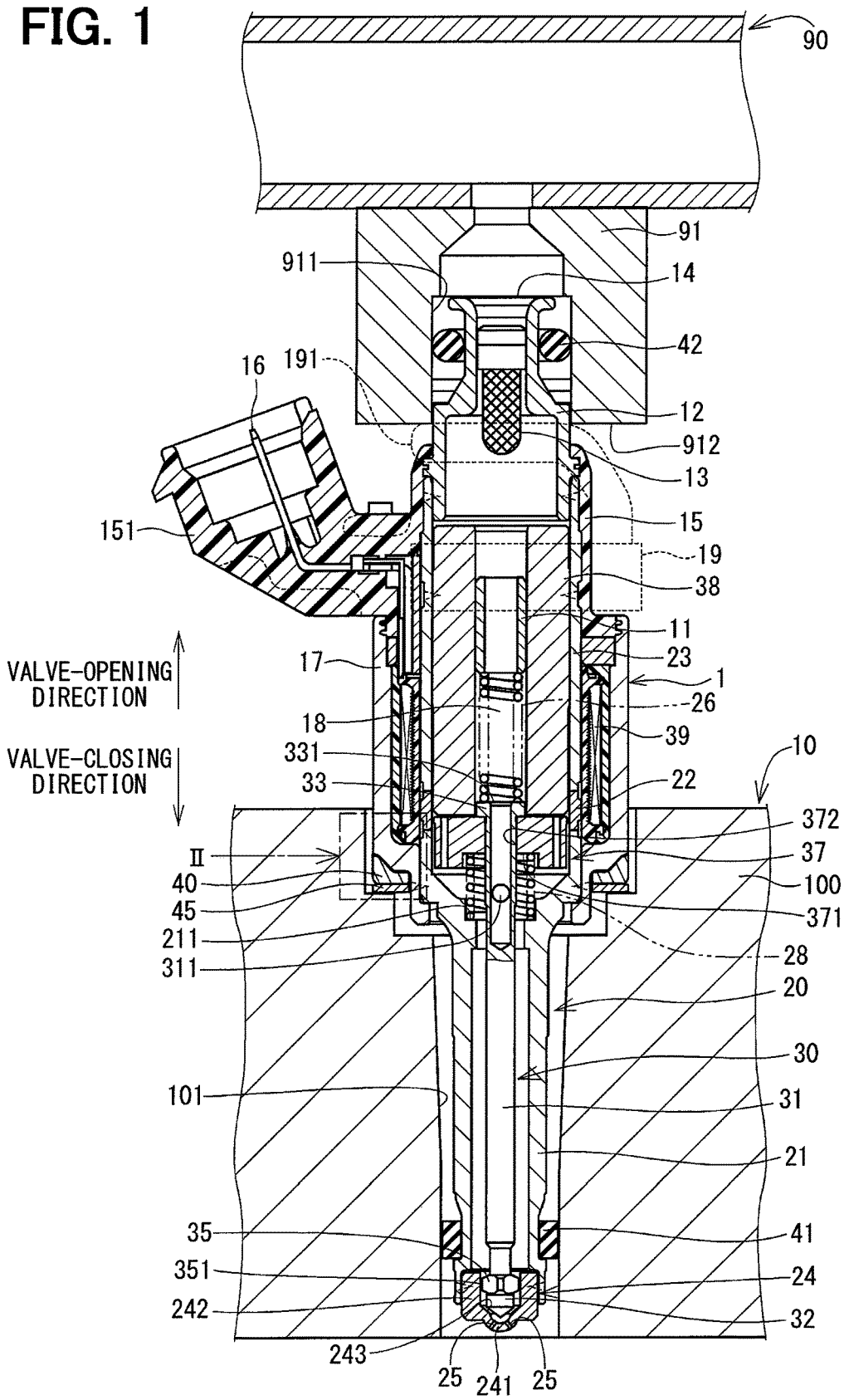
FIG. 1 is a sectional view illustrating a fuel injection valve in accordance with a first embodiment.
Figure 2:
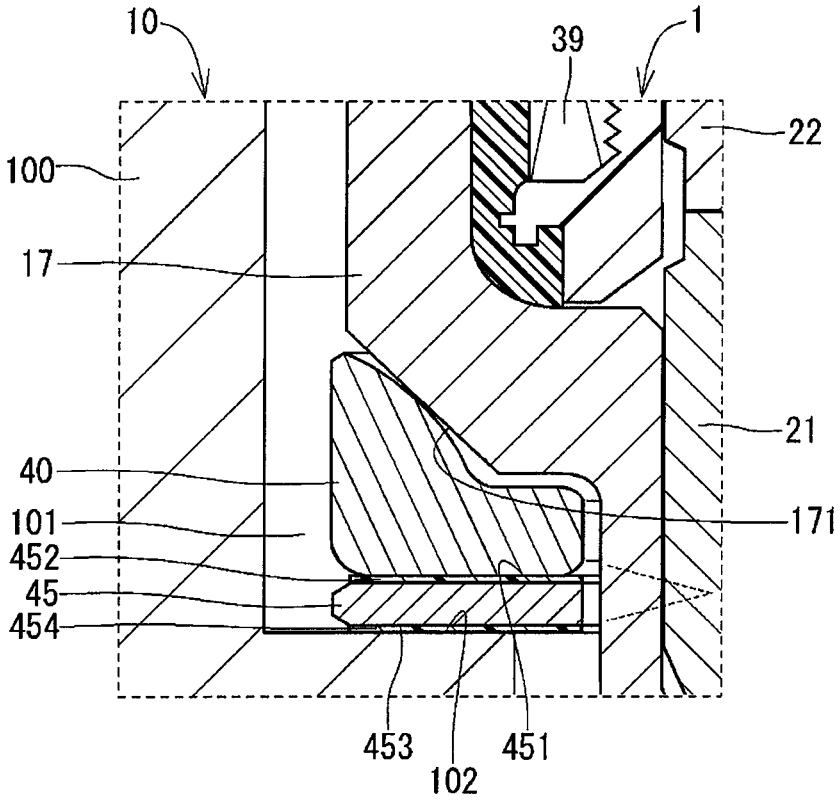
FIG. 2 is an enlarged view illustrating a part II in FIG. 1.

A fuel injection valve 1 of a first embodiment is illustrated in FIGS. 1 and 2. The fuel injection valve 1 is provided at a cylinder head 100 of an engine 10 as an "internal-combustion engine" to inject gasoline, as fuel flowing through a delivery pipe 90, directly into a cylinder as a "combustion chamber" (not shown) of the engine 10. FIG. 1 illustrates a valve-opening direction, which is a direction in which a needle 30 is disengaged from a valve seat 243, and a valve-closing direction, which is a direction in which the needle 30 is brought into contact with the valve seat 243.

The structure of the fuel injection valve 1 will be explained below. The fuel injection valve 1 includes a housing 20, the needle 30, a movable core 37, a fixed core 38, a coil 39, springs 26, 28, a tolerance ring 40 serving as a "shift permitting member", and a washer 45 serving as a "friction reducing part".

As illustrated in FIG. 1, the housing 20 includes a first cylindrical member 21, a second cylindrical member 22, a third cylindrical member 23, and an injection nozzle 24. The first cylindrical member 21, the second cylindrical member 22, and the third cylindrical member 23 are all formed into a generally cylindrical shape. The first cylindrical member 21, the second cylindrical member 22, and the third cylindrical member 23 are arranged coaxially in this order, and are connected to each other.

The first cylindrical member 21 and the third cylindrical member 23 are formed from a magnetic material such as ferritic stainless steel, and magnetic stabilizing treatment is performed thereon. The second cylindrical member 22 is formed from a non-magnetic material such as austenitic stainless steel.

The injection nozzle 24 is provided at an end portion of the first cylindrical member 21 on its opposite side from the second cylindrical member 22. The injection nozzle 24 is formed into a cylindrical shape having a bottom from metal such as martensitic stainless steel. The injection nozzle 24 includes an injection part 241 and a cylindrical part 242.

The injection part 241 includes nozzle holes 25 that communicate between the inside and outside of the housing 20. The annular valve seat 243 is formed along an edge of an inner opening of the nozzle hole 25, which is an opening on the inner side of the housing 20.

The cylindrical part 242 is formed in a generally cylindrical shape. The cylindrical part 242 is connected to a radially outward portion of the injection part 241, and is provided between the injection part 241 and the first cylindrical member 21.

The needle 30 is formed from metal such as martensitic stainless steel. Quenching treatment is performed on the needle 30 so that the needle 30 has approximately the same degree of hardness as the hardness of the injection nozzle 24. The needle 30 is accommodated in the housing 20. The needle 30 includes a shaft part 31, a seal part 32, and a large diameter part 33. The shaft part 31, the seal part 32, and the large diameter part 33 are integrally formed.

The shaft part 31 is formed into a cylindrical rod shape. The portion of the shaft part 31 near the seal part 32 includes a sliding contact part 35. The sliding contact part 35 is formed into a generally cylindrical shape, and a part of its outer wall 351 is chamfered. A non-chamfered portion of the outer wall 351 of the sliding contact part 35 can be in sliding contact with an inner wall of the cylindrical part 242 of the injection nozzle 24. Accordingly, the reciprocation movement of the needle 30 at its end portion on the valve seat 243-side is guided. The shaft part 31 includes a hole 311 that connects an inner wall and an outer wall of the shaft part 31.

The seal part 32 is provided at an end portion of the shaft part 31 on the valve seat 243-side, and can be in contact with the valve seat 243. When the seal part 32 is disengaged from the valve seat 243 or is brought into contact with the valve seat 243, the needle 30 opens or closes the nozzle holes 25 to allow or block the communication between the inside and outside of the housing 20.

The large diameter part 33 is provided on an opposite side of the shaft part 31 from the seal part 32. The large diameter part 33 is formed such that its outer diameter is larger than an outer diameter of the shaft part 31. An end surface of the large diameter part 33 on the valve seat 243-side is in contact with the movable core 37.

The needle 30 reciprocates in the housing 20 in the axial direction of the housing 20, with the sliding contact part 35 supported by the inner wall of the injection nozzle 24 and the shaft part 31 supported by an inner wall of the second cylindrical member 22 via the movable core 37.

The movable core 37 is formed into a generally cylindrical shape from a magnetic material such as ferritic stainless steel, and for example, chrome plating is performed on its surface. Magnetic stabilizing treatment is performed on the movable core 37. The hardness of the movable core 37 is relatively low, and is substantially the same as the hardness of the first cylindrical member 21 and the third cylindrical member 23. A through hole 372 is formed generally through the center of the movable core 37. The shaft part 31 is inserted through the through hole 372.

The fixed core 38 is formed into a generally cylindrical shape from a magnetic material such as ferritic stainless steel. Magnetic stabilizing treatment is performed on the fixed core 38. Although the hardness of the fixed core 38 is substantially the same as the hardness of the movable core 37, the fixed core 38 ensures a necessary hardness by performing, for example, chrome plating on its surface to provide the function of the movable core 37 as a stopper. The fixed core 38 is welded to the third cylindrical member 23, and is provided to be fixed to the inside of the housing 20.

The coil 39 is formed into a generally cylindrical shape, and is provided to surround mainly radially outward parts of the second cylindrical member 22 and the third cylindrical member 23. The coil 39 generates magnetic force when supplied with electricity. When the magnetic force is produced in the coil 39, a magnetic circuit is formed in the fixed core 38, the movable core 37, the first cylindrical member 21, and the third cylindrical member 23. Accordingly, magnetic attraction force is generated between the fixed core 38 and the movable core 37, so that the movable core 37 is attracted to the fixed core 38. In this case, the needle 30, which is in contact with the surface of the movable core 37 on an opposite side of the needle 30 from the valve seat 243-side, moves together with the movable core 37 toward the fixed core 38, i.e., in the valve-opening direction.

The spring 26 is provided such that one end of the spring 26 is in contact with a spring contact surface 331 of the large diameter part 33. The other end of the spring 26 is in contact with one end of an adjusting pipe 11 that is press-fitted and fixed inward of the fixed core 38. The spring 26 has the force extending in the axial direction of the housing 20. Accordingly, the spring 26 urges the needle 30 together with the movable core 37 toward the valve seat 243, i.e., in the valve-closing direction.

The spring 28 is provided such that one end of the spring 28 is in contact with a stepped part 371 of the movable core 37. The other end of the spring 28 is in contact with an annular stepped surface 211 that is formed inward of the first cylindrical member 21. The spring 28 has the force extending in the axial direction of the housing 20. Accordingly, the spring 28 urges the movable core 37 together with the needle 30 in a direction opposite from the valve seat 243, i.e., in the valve-opening direction.

In the present embodiment, the urging force of the spring 26 is set to be larger than the urging force of the spring 28. Accordingly, in a state where electricity is not supplied to the coil 39, the seal part 32 is in a state where the seal part 32 is engaged with the valve seat 243, i.e., in a valve-closed state.

A fuel introduction pipe 12 having a generally cylindrical shape is press-fitted and welded to the end part of the third cylindrical member 23 on its opposite side from the second cylindrical member 22. A filter 13 is provided inside the fuel introduction pipe 12. The filter 13 collects foreign substances contained in the fuel flowing into the valve 1 through an introduction port 14 of the fuel introduction pipe 12.

A mold part 15 that is formed from resin is provided radially outward of the fuel introduction pipe 12 and the third cylindrical member 23. A connector 151 is formed radially outward of the mold part 15. A terminal 16 for supplying electricity to the coil 39 is insert-molded in the connector 151. A cylindrical first holder 17 is provided radially outward of the coil 39 to cover the coil 39.

The position at which the fuel injection valve 1 of the first embodiment is provided will be described below. As illustrated in FIG. 1, the fuel injection valve 1 is provided between the cylinder head 100 and the delivery pipe 90.

The first cylindrical member 21-side of the fuel injection valve 1 is inserted in a through hole 101 of the cylinder head 100. In this case, as illustrated in FIG. 2, a tapered surface 171 of the first holder 17 is in contact with an inner wall 102 that defines the through hole 101 via the tolerance ring 40, the washer 45 and so forth. At the time of attachment of the fuel injection valve 1 and the cylinder head 100 in a production process of the fuel injection valve 1, the tolerance ring 40 absorbs a shift of the position of attachment of the cylinder head 100 and the fuel injection valve 1 that is caused by forming accuracy to permit the position shift. A lubricating film 452 serving as a "friction reducing part" or a "lubricative coating" for reducing the friction is formed on a first contact surface 451 of the washer 45 that is in contact with the tolerance ring 40. A lubricating film 454 serving as a "friction reducing part" or a "lubricative coating" for reducing the friction is formed on a second contact surface 453 of the washer 45 that is in contact with the inner wall 102 of the cylinder head 100. The air-tightness in the through hole 101 of the cylinder of the engine 10 is maintained by an annular sealing member 41 that is provided radially outward of the end part of the first cylindrical member 21 on the injection nozzle 24-side.

The fuel introduction pipe 12-side of the fuel injection valve 1 is inserted in a flow passage 911 of a connecting part 91 of the delivery pipe 90. In this case, the liquid-tightness of the flow passage 911 is maintained by an annular sealing member 42 that is provided radially outward of the fuel introduction pipe 12. A second holder 19 that supports the mold part 15 and that is in contact with the delivery pipe 90 is provided radially outward of the mold part 15 as well as on an opposite side of the valve 1 from the connector 151. An end part 191 of the second holder 19 on the delivery pipe 90-side is in contact with an end surface 912 of the connecting part 91 on the engine 10-side.

In the fuel injection valve 1, the fuel supplied from the delivery pipe 90 flows through the introduction port 14, radially inward of the fixed core 38, the inside of the adjusting pipe 11, the inside of the large diameter part 33 and the shaft part 31, the fixed core 38, and the clearance between the first cylindrical member 21 and the shaft part 31 of the needle 30, to be guided into the injection nozzle 24. Thus, the passage from the introduction port 14 to the clearance between the first cylindrical member 21 and the shaft part 31 of the needle 30 is configured as a fuel passage 18 for introducing fuel into the injection nozzle 24.

Figure 3A:
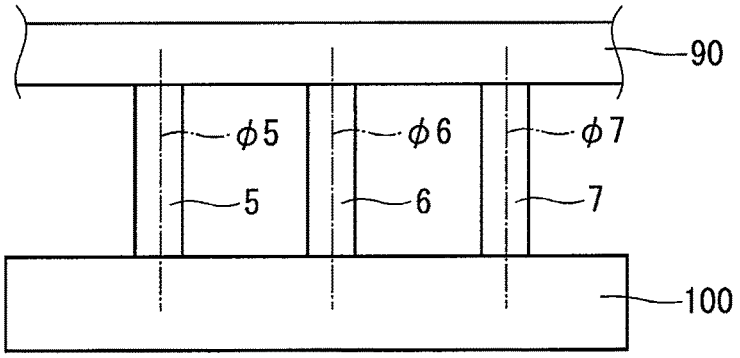
FIG. 3A is a schematic view illustrating a positional relationship between a cylinder head and a delivery pipe at time of attachment of the fuel injection valve and at time of actual use of the fuel injection valve, the view illustrating the positional relationship when the cylinder head, the fuel injection valve, and the delivery pipe are attached together in a production process according to the first embodiment.
Figure 3B:
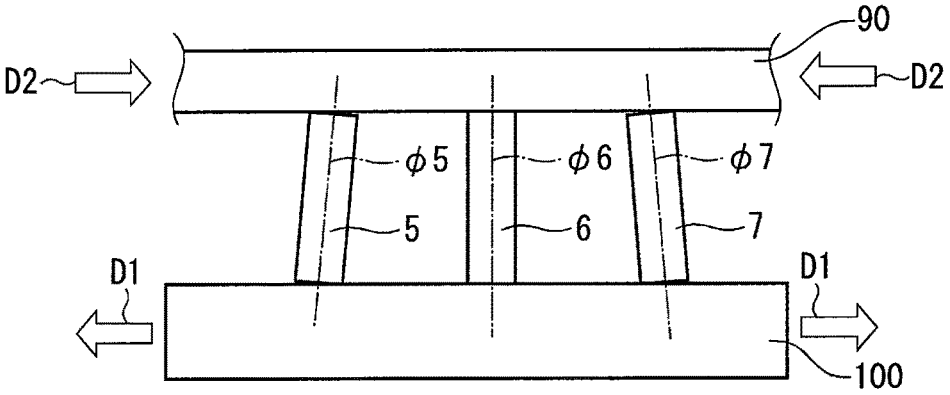
FIG. 3B is a schematic view illustrating a positional relationship between the cylinder head and the delivery pipe at time of attachment of the fuel injection valve and at time of actual use of the fuel injection valve, the view illustrating the positional relationship when an engine is driven under a relatively low-temperature environment according to the first embodiment.

The operation of the fuel injection valve 1 of the first embodiment will be described below with reference to FIGS. 3A and 3B. FIGS. 3A and 3B are diagrams schematically illustrating the positional relationship between the cylinder head 100, the fuel injection valves, and the delivery pipe 90. In FIGS. 3A and 3B, the fuel injection valves are referred to as fuel injection valves 5, 6, 7 from the left side on a plane of paper for descriptive purposes.

As illustrated in FIG. 3A, at the time of attachment of the cylinder head 100, the fuel injection valves 5, 6, 7 and the delivery pipe 90, the fuel injection valves 5, 6, 7 are attached to the cylinder head 100 at predetermined positions. In this case, the position shift of the fuel injection valve 1 relative to the cylinder head 100 and the delivery pipe 90 is corrected by the tolerance ring 40.

However, when driving the engine 10 under a relatively low-temperature environment, the cylinder head 100 has a high temperature due to combustion in the cylinder as illustrated in FIG. 3B. Accordingly, the cylinder head 100 expands to extend in directions of white arrows D1. On the other hand, the delivery pipe 90 contracts to shrink in directions of white arrows D2 due to the low-temperature gasoline flowing in the pipe 90. Accordingly, a position shift is caused between the cylinder head 100 and the delivery pipe 90.

Specifically, as illustrated in FIG. 3B, the fuel injection valve 6 of the three fuel injection valves 5, 6, 7 that is located generally at the center with respect to the cylinder head 100 and the delivery pipe 90 is not easily influenced by the expansion of the cylinder head 100 or the contraction of the delivery pipe 90. The force to incline the central axis $\phi$6 of the fuel injection valve 6 is not applied to the fuel injection valve 6. However, the force is applied to the fuel injection valve 5 located on a left side of the fuel injection valve 6 to incline its central axis $\phi$5 toward the fuel injection valve 6. The force is applied to the fuel injection valve 7 located on a right side of the fuel injection valve 6 to incline its central axis $\phi$7 toward the fuel injection valve 6.

In the fuel injection valve, at the time of actual use, the contact surface between the cylinder head and the tolerance ring is pressed on the inner wall of the through hole of the cylinder head by the load from the delivery pipe by the second holder, and the fuel pressure, which is a pressure of fuel supplied to the fuel injection valve. The frictional force between the tolerance ring and the cylinder head increases by this pressing, and thus displacement of the fuel injection valve relative to the cylinder head, particularly, displacement in a direction perpendicular to the central axis of the housing becomes difficult. "Perpendicular" means not only being perpendicular in the strict sense but also such an extent of angular relation that can be visually recognized as being perpendicular to the axial direction of the housing. Accordingly, the force in a direction different from the direction of the central axis of the fuel injection valve is applied to the fuel injection valve due to the position shift between the cylinder head and the delivery pipe, and thus injection characteristics of the fuel injection valve deteriorate.

Figure 4:
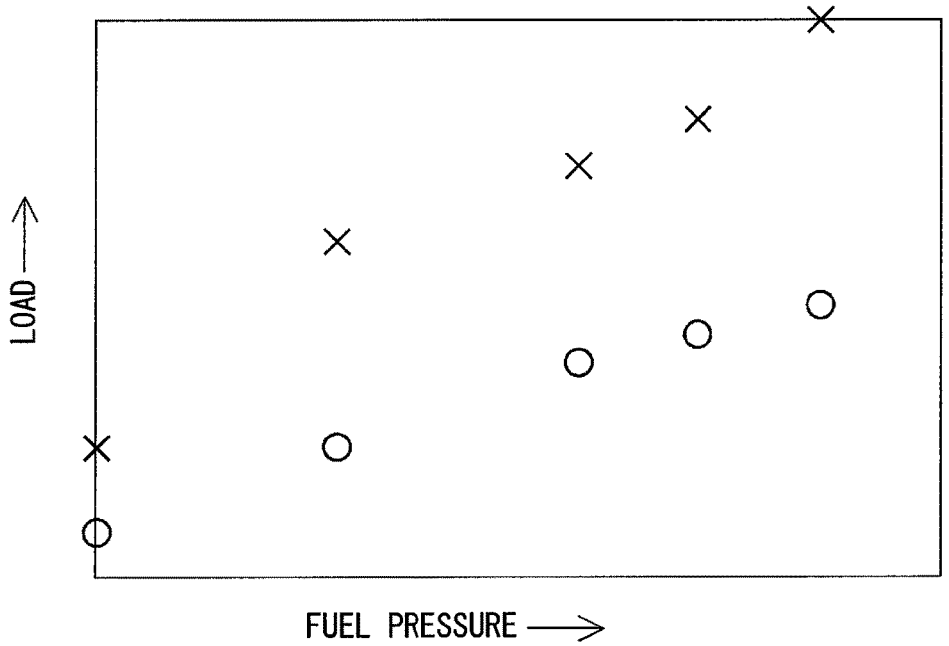
FIG. 4 is a characteristic diagram illustrating fuel injection characteristics of the fuel injection valve of the first embodiment.

FIG. 4 illustrates a result of experiment on a relationship between a lateral load that can shift the fuel injection valve relative to the cylinder head and the fuel pressure. In FIG. 4, the experimental result indicating the relationship between the lateral load and the fuel pressure in the fuel injection valve 1 of the first embodiment is represented by signs O. As a comparative example, an experimental result indicating a relationship between a lateral load and a fuel pressure in a fuel injection valve that does not have a washer between a tolerance ring and a cylinder head is represented by signs X.

As illustrated in FIG. 4, in the fuel injection valve, as the fuel pressure becomes higher, the lateral load that can shift the fuel injection valve relative to the cylinder head becomes larger. Thus, it is shown that the movement of the fuel injection valve relative to the cylinder head becomes more difficult when the fuel pressure becomes higher.

In comparison between the experimental result for the fuel injection valve 1 of the first embodiment and the experimental result for the fuel injection valve of the comparative example, it becomes evident that the lateral load that can shift the fuel injection valve 1 of the first embodiment is smaller than the lateral load that can shift the fuel injection valve of the comparative example under the same fuel pressure. Thus, the fuel injection valve 1 of the first embodiment can slide sideways with a small load even though the fuel pressure becomes high as compared to the fuel injection valve of the comparative example.

As described above, the fuel injection valve 1 of the first embodiment is easily displaced relative to the cylinder head 100 due to the washer 45 that is provided between the tolerance ring 40 and the cylinder head 100. Accordingly, the force applied to the fuel injection valve 1 due to the position shift between the cylinder head 100 and the delivery pipe 90 is relieved by the displacement of the fuel injection valve 1 relative to the cylinder head 100 to prevent the fuel injection valve 1 from being deformed due to this force. Therefore, the deformation of the fuel injection valve 1 can prevent deterioration of fuel injection characteristics of the fuel injection valve 1. In addition, damage to the fuel injection valve 1 can be prevented.

Second Embodiment

Figure 5:
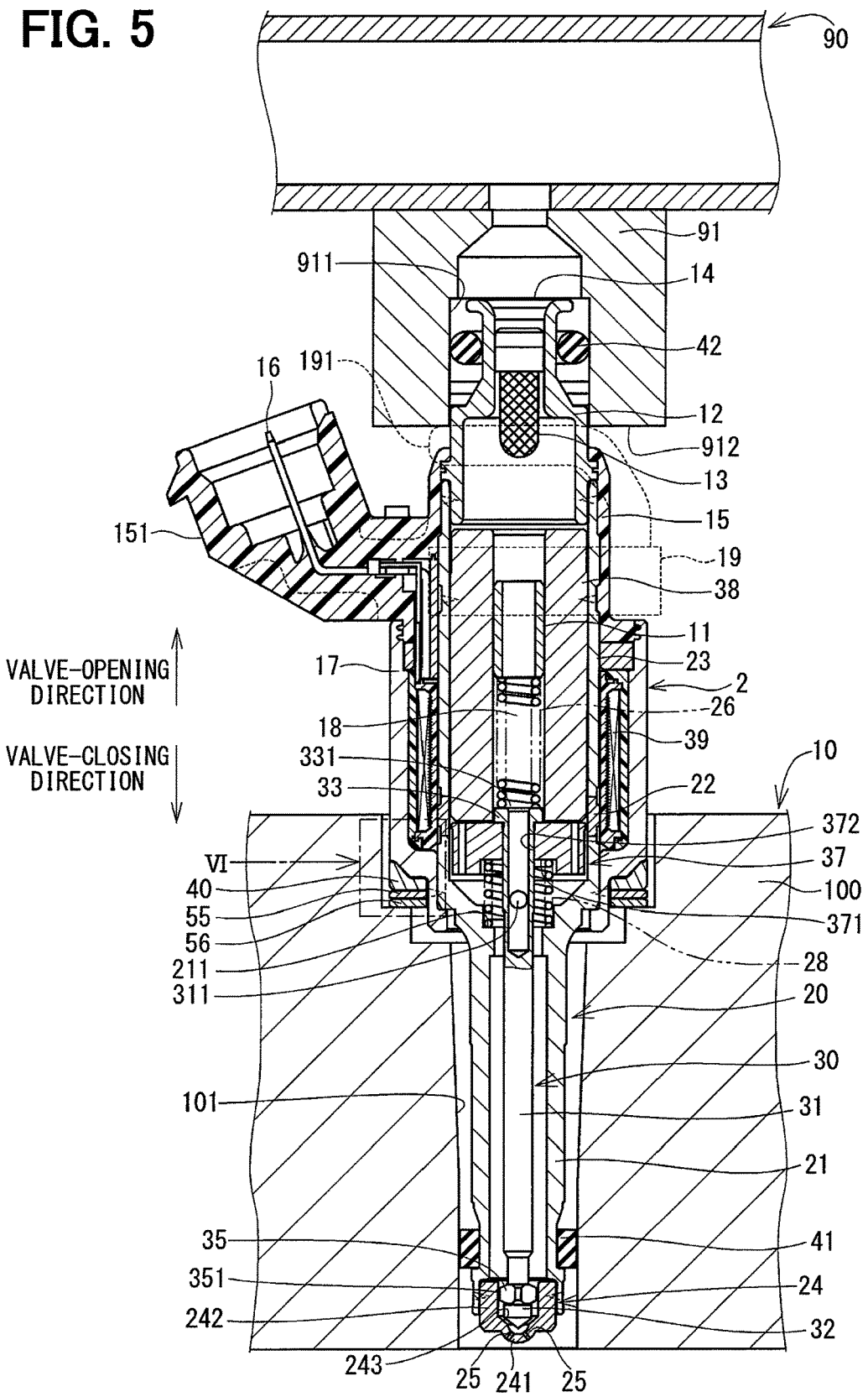
FIG. 5 is a sectional view illustrating a fuel injection valve in accordance with a second embodiment.
Figure 6:
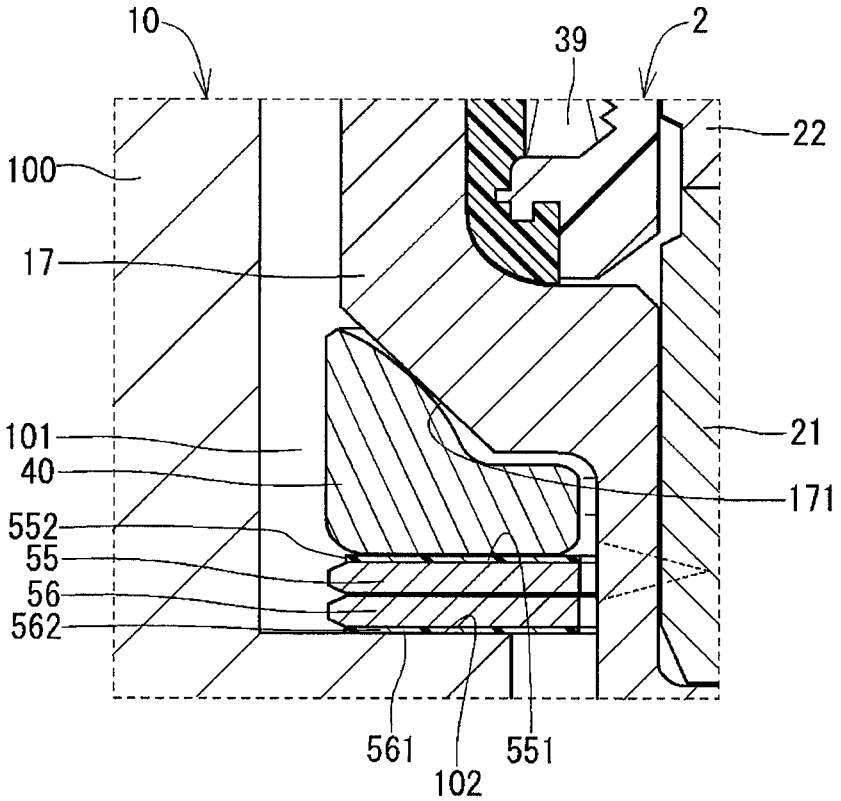
FIG. 6 is an enlarged view illustrating a part VI in FIG. 5.

A fuel injection valve of a second embodiment will be described with reference to FIGS. 5 and 6. The number of washers in the second embodiment is different from the first embodiment. For substantially the same component parts as in the first embodiment, the same corresponding reference numerals are used to omit their descriptions.

A fuel injection valve 2 of the second embodiment includes two washers 55, 56 serving as a "friction reducing part" between a tolerance ring 40 and an inner wall 102 of a cylinder head 100. A lubricating film 552 serving as a "friction reducing part" or a "lubricative coating" is formed on a first contact surface 551 of the washer 55 that is in contact with the tolerance ring 40. A lubricating film 562 serving as a "friction reducing part" or a "lubricative coating" is formed on a second contact surface 561 of the washer 56 that is in contact with the inner wall 102 of the cylinder head 100.

The fuel injection valve 2 is easily displaced relative to the cylinder head 100 due to the two washers 55, 56 that are provided between the tolerance ring 40 and the cylinder head 100. Accordingly, the second embodiment produces the same effect as in the first embodiment.

For example, if the cylinder head 100 is formed from aluminum, which is softer than the tolerance ring 40 that is formed from stainless steel, the inner wall 102 of the cylinder head 100 that is in contact with the washer 56 may be deformed and the washer 56 may be buried in the inner wall 102 due to the pressure of fuel supplied from a delivery pipe 90 or the load from the delivery pipe 90 by a second holder 19. Even though the washer 56 is buried in the cylinder head 100 due to the deformation of the inner wall 102, the fuel injection valve 2 of the second embodiment easily slides sideways because of the washer 55. Therefore, even though the cylinder head 100 is deformed, the fuel injection valve 2 of the second embodiment can further prevent the deterioration of fuel injection characteristics of the fuel injection valve 2 due to the position shift between the cylinder head 100 and the delivery pipe 90.

Third Embodiment

Figure 7:
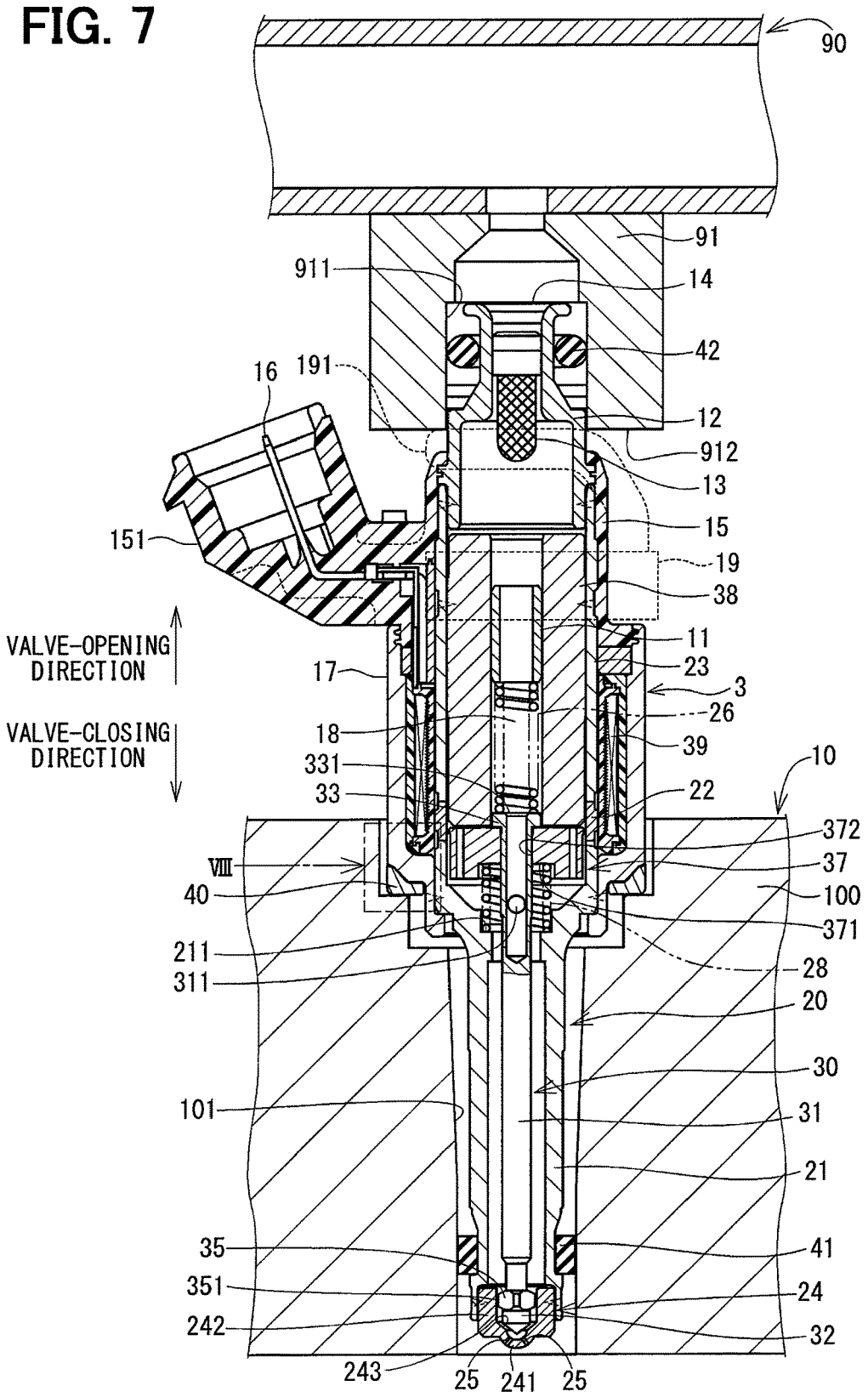
FIG. 7 is a sectional view illustrating a fuel injection valve in accordance with a third embodiment.
Figure 8:
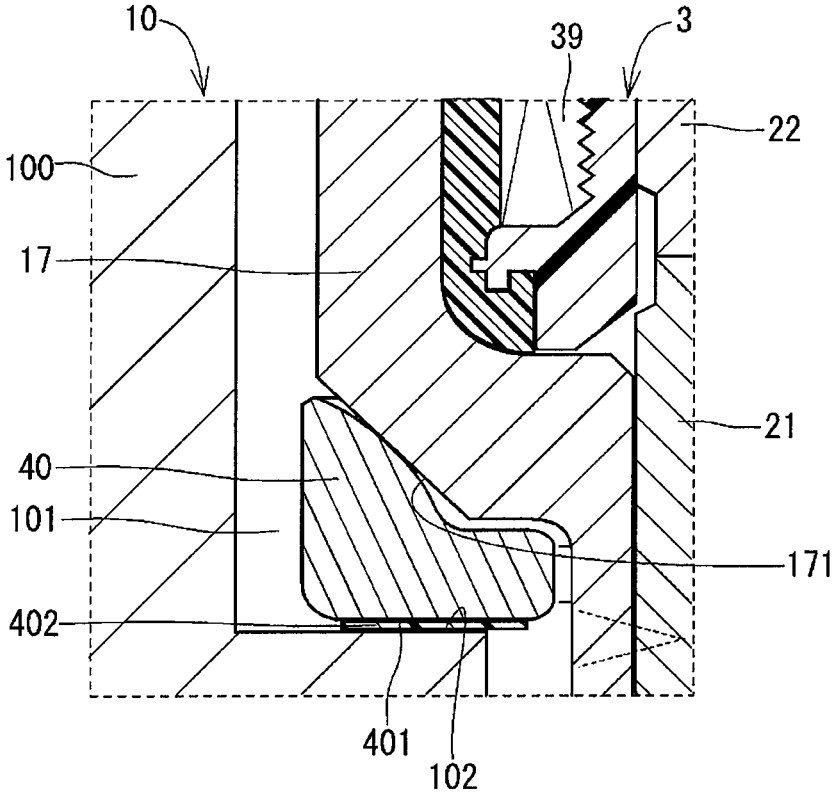
FIG. 8 is an enlarged view illustrating a part VIII in FIG. 7.

A fuel injection valve of a third embodiment will be described with reference to FIGS. 7 and 8. The third embodiment is different from the first embodiment in that a lubricating film is formed on a tolerance ring. For substantially the same component parts as in the first embodiment, the same corresponding reference numerals are used to omit their descriptions.

A tolerance ring 40 is provided for a fuel injection valve 3 of the third embodiment between a first holder 17 and a cylinder head 100. A lubricating film 402 serving as a "friction reducing part" or a "lubricative coating" is formed on a third contact surface 401 of the tolerance ring 40 that is in contact with an inner wall 102 of the cylinder head 100.

The fuel injection valve 3 of the third embodiment is easily displaced relative to the cylinder head 100 due to the lubricating film 402 that is formed between the tolerance ring 40 and the cylinder head 100. Accordingly, the third embodiment produces the same effect as in the first embodiment.

Modifications to the above-described embodiments will be described below. In the first embodiment, the lubricating films are formed on the first contact surface and the second contact surface of the washer. In the second embodiment, the lubricating films are formed on the first contact surface of the washer on the tolerance ring-side and on the second contact surface of the washer on the cylinder head-side. However, the lubricating films do not need to be formed on these contact surfaces.

One washer is provided in the first embodiment, and two washers are provided in the second embodiment. However, the number of washers provided is not limited to these numbers. There may be no washers as in the third embodiment, or three or more washers may be provided.

The present disclosure is not limited to these embodiments, and can be embodied in various modes without departing from the scope of the disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A fuel injection valve for injecting fuel directly into a combustion chamber of an internal-combustion engine, the valve comprising:

a cylindrical housing that includes:

a nozzle hole which is formed at one axial end of the housing and through which fuel is injected;

a valve seat that is formed around the nozzle hole; and a fuel passage through which fuel flows toward the nozzle hole;

a needle that is accommodated in the housing to be capable of reciprocating in an axial direction of the housing and that separates from or contacts with the valve seat to open or close the nozzle hole;

a coil that generates a magnetic field when energized;

a fixed core that is fixed in the magnetic field generated by the coil in the housing;

a movable core that is provided on the valve seat-side of the fixed core to be capable of reciprocating in the axial direction of the housing and that is attracted to the fixed core when the coil is energized;

a shift permitting member that is at a first location configured to be between the housing and the internal-combustion engine and is configured to permit a shift of an attachment position at time of attachment of the housing and the internal-combustion engine;

a flat annular washer that is at a second location configured to be between the internal-combustion engine and the shift permitting member and is configured to reduce friction between the internal-combustion engine and the shift permitting member, wherein the flat annular washer is configured to permit displacement of the housing in a direction perpendicular to the axial direction of the housing;

the shift permitting member is in contact with a tapered surface of the housing;

the flat annular washer is not in contact with the housing in the axial direction of the housing;

the washer is configured to be in contact with an inner wall of a cylinder head of the internal-combustion engine;

a first contact surface and a second contact surface of the washer are respectively flat surfaces, and are configured to be generally parallel to the inner wall of the cylinder head; and a surface of the shift permitting member that is in contact with the washer is configured to be generally parallel to the inner wall of the cylinder head.

2. The fuel injection valve according to claim 1, wherein the washer is one of a plurality of washers.

3. The fuel injection valve according to claim 1, wherein the washer includes a lubricative coating on at least one of:

a first contact surface of the washer on which the shift permitting member and the washer are in contact; and a second contact surface of the washer on which the internal-combustion engine and the washer are configured to be in contact.

4. The fuel injection valve according to claim 1, wherein the surface of the shift permitting member is in contact with one of the first contact surface and the second contact surface of the washer.

* * * * *